United States Patent [19]

Sugimoto

[11] Patent Number: 4,704,884

[45] Date of Patent: Nov. 10,,1987

[54] DOUBLE-ACTING LOCKING DEVICE FOR JOINT CONTROL

[75] Inventor: Naoyuki Sugimoto, Koganei, Japan

[73] Assignee: Takigen Seizou Co. Ltd., Tokyo, Japan

[21] Appl. No.: 928,599

[22] Filed: Nov. 5, 1986

Related U.S. Application Data

[63] Continuation of Ser. No. 611,330, May 17, 1984, abandoned.

[30] Foreign Application Priority Data

May 21, 1983 [JP] Japan ..... 58-89618

[51] Int. Cl.[4] ..... E05B 27/08; E05B 35/08

[52] U.S. Cl. ..... 70/337; 70/338; 70/339; 70/363

[58] Field of Search ..... 70/337, 343, 404, 363

[56] References Cited

U.S. PATENT DOCUMENTS

| | | | |
|---|---|---|---|
| 1,141,463 | 6/1915 | Hurd | 70/337 |
| 3,149;321 | 9/1964 | Ward | 70/337 |
| 3,264,632 | 8/1966 | Ward | 70/337 |
| 3,729,964 | 5/1973 | Hsu | 70/338 |
| 3,738,136 | 6/1973 | Falk | 70/340 |
| 3,916,657 | 11/1975 | Steinbach | 70/339 |

*Primary Examiner*—Robert L. Wolfe
*Assistant Examiner*—Vinh Luong
*Attorney, Agent, or Firm*—Martin Smolowitz

[57] ABSTRACT

A double-acting locking device of the axial pin tumbler type for joint control. A rotary plug, a control plug, a master plug and a stationary plug fit in contact with each other within a cylinder. Connections and disconnections between those plugs are effected by the actions of top pins, master pins and bottom pins, all of which fit into axial pin holes formed in those plugs and are spring-biased forward. The selection of the connections and disconnections of the plugs is effected by a first key, a second key, and a master key. The rotational directions and angles of the actuating shaft set by the first and second keys are controlled by the actions of front and rear face projections on the control plug, a rear face recess of the rotary plug, and a front face recess of the master plug.

5 Claims, 21 Drawing Figures

SEC. C-C' OF FIG.6

SEC. E-E' OF FIG.15

SEC. F-F' OF FIG. 18

DOUBLE-ACTING LOCKING DEVICE FOR JOINT CONTROL

This application is a continuation of application Ser. No. 06/611,330 filed on May 17, 1984 now abandoned.

BACKGROUND OF THE INVENTION

1. Field of the Invention

The present invention relates to a locking device and, more particularly, to a double-acting locking device for joint control which can control two independent actions together.

2. Description of the Prior Art

A double-acting locking device for control is disclosed in Japanese Utility Model Publication No. 23383/1978. This device adopts as its fundamental construction an ordinary cylinder lock using a flat key. As a result of this construction, an extension of the flat key which projects from the back of the cylinder lock body is formed so that its side edge has a drive portion which is separate from the intrinsic key lands, and is used for driving the object being actuated, e.g., a switch. Thus, the key is so long that it is inconvenient to transport and store, and that it is liable to become warped and deformed, causing problems in operation.

SUMMARY OF THE INVENTION

It is, therefore, an object of the present invention to provide a double-acting locking device for joint control which utilizes an axial pin tumbler lock, which does not use the flat keys with the above problems.

According to a feature of the present invention, a double-acting locking device for joint control is provided, comprising: a stationary plug provided with a plurality of axial pin holes; a cylinder mounted coaxially on the front end of the stationary plug; a rotary plug fitting rotatably into the cylinder, and which is provided with an actuating shaft on its rear face and a plurality of axial pin holes; a control plug fitting rotatably into said cylinder in contact with the rear face of the rotary plug, and which is provided with a plurality of axial pin holes, the control plug defining together with the rotary plug a first shear line therebetween; a master plug fitting rotatably into the cylinder in contact with both the rear face of the control plug and the front face of the stationary plug, and which is provided with a plurality of axial pin holes, the master plug defining together with the control plug a second shear line therebetween, and together with the stationary plug a master shear line therebetween; top pins, master pins, and bottom pins inserted together into the axial pin holes of the rotary plug, the control plug, the master plug, and the stationary plug; a plurality of springs fitting into the pin holes of the stationary plug so as to bias the top pins, master pins and bottom pins forward; a first key which brings the rear ends of the top pins and the front ends of the master pins into alignment with the first shear line so that only said rotary plug can rotate; a second key which brings the rear ends of the top pins and the front ends of the master pins into alignment with the second shear line so that only the rotary plug and the control plug can rotate; and a master key which brings the rear ends of the master pins and the front ends of the bottom pins into alignment with the master shear line so that the rotary plug, the control plug, and the master plug can rotate. The control plug is provided with projections on each of its front and rear faces, the rotary plug has a recess in its rear face into which the front face projection of the control plug can fit loosely, and the master plug has a recess in its front face into which the rear face projection of the control plug can fit loosely, so that the directions in which the actuating shaft is rotated by the first and second keys are made to be opposite to each other according to the way in which side walls of the projections come into contact with side walls of the recesses.

BRIEF DESCRIPTION OF THE DRAWINGS

Other objects, features and advantages of the present invention will become apparent from the following description taken in conjunction with one embodiment thereof, with reference to the accompanying drawings, in which:

FIG. 3 is a front elevation of a rotary plug and an actuating shaft;

FIG. 14 is a section taken along the line D—D′ of FIG. 12.

DESCRIPTION OF THE PREFERRED EMBODIMENT

Figure 1:
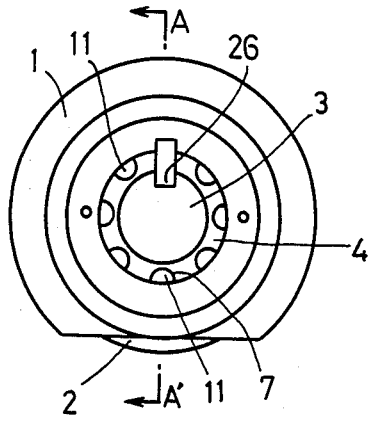
FIG. 1 is a front elevation view of the double-acting locking device for joint control, from which the key is extracted.
Figure 2:
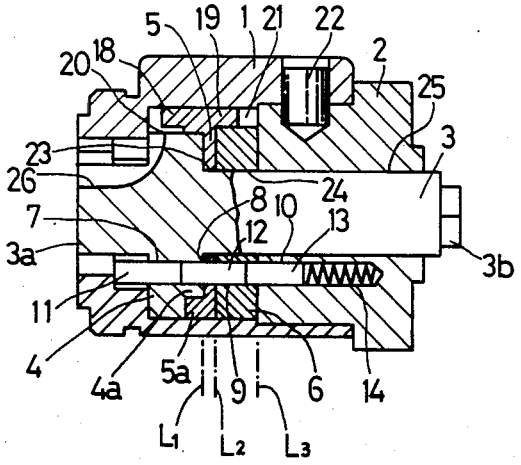
FIG. 2 is a section taken along the line A—A′ of FIG. 1.
Figure 3:
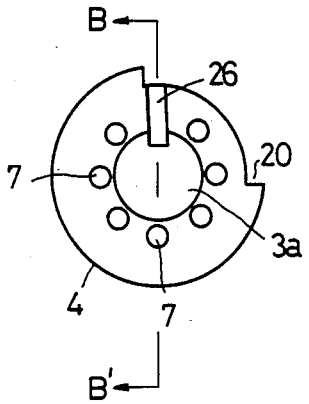
In FIGS. 3 and 14, showing various parts which are used in the locking device of FIG. 1.
Figure 4:
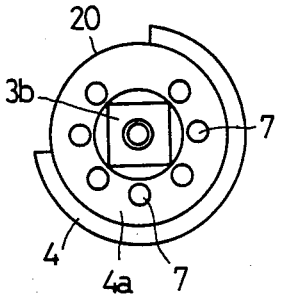
FIG. 4 is a rear elevation of the rotary plug and the actuating shaft.
Figure 5:
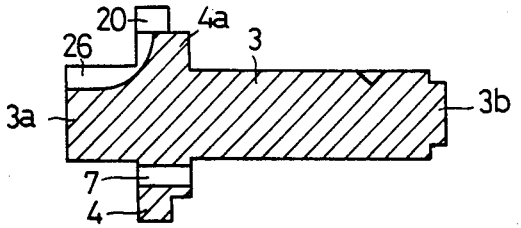
FIG. 5 is a section taken along the line B—B′ of FIG. 3.
Figure 6:
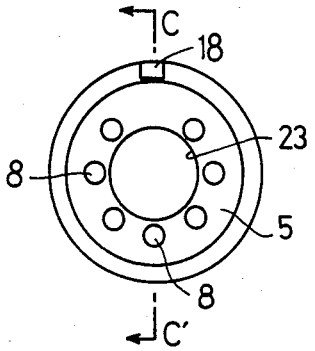
FIG. 6 is a front elevation of a control plug.
Figure 7:
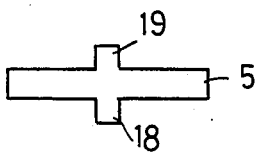
FIG. 7 is a top plan view of the control plug.
Figure 8:
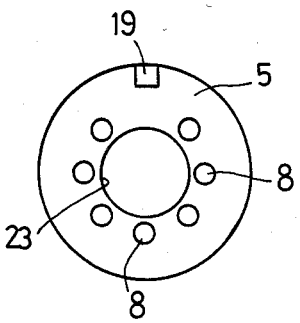
FIG. 8 is a rear elevation of the control plug.
Figure 9:
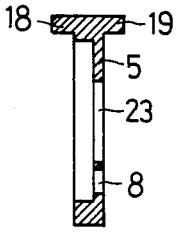
FIG. 9 is a section taken along the line C—C′ of FIG. 6.
Figure 10:
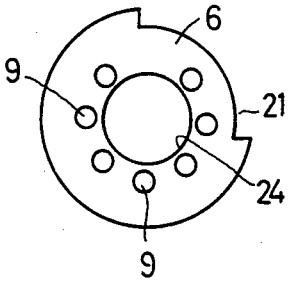
FIG. 10 is a front elevation of a master plug.
Figure 11:
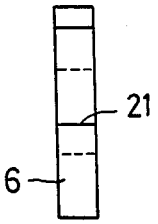
FIG. 11 is a righthand side elevation of the master plug.
Figure 12:
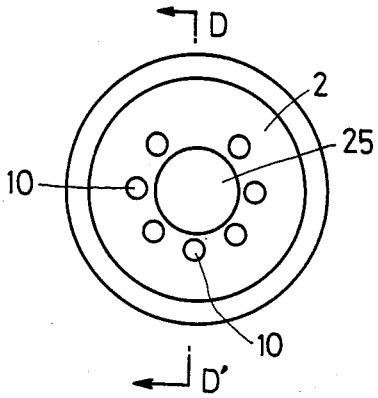
FIG. 12 is a front elevation of a stationary plug.
Figure 13:
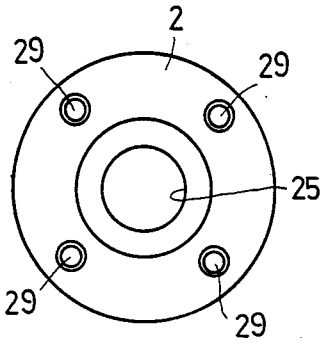
FIG. 13 is a rear elevation of the stationary plug.
Figure 14:
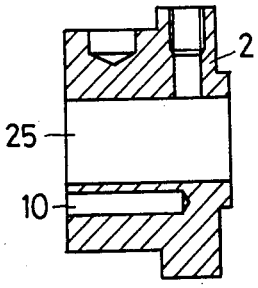

The present invention will now be described with reference to the accompanying drawings. A double-acting locking device for joint control according to the present invention is constructed of: a stationary plug 2 provided with a plurality of axial pin holes 10; a cylinder 1 mounted coaxially on the front end of the stationary plug 2; a rotary plug 4 fitting rotatably into the cylinder 1 and which is provided with an actuating shaft 3 on its rear face and a plurality of axial pin holes 7; a control plug 5 fitting rotatably into the cylinder 1 in contact with the rear face of the rotary plug 4 and which is provided with a plurality of axial pin holes 8, the control plug 5 defining together with the rotary plug 4 a first shear line $L_1$ therebetween; a master plug 6 fitting rotatably into the cylinder 1 in contact with both the rear face of the control plug 5 and the front face of the stationary plug 2, and which is provided with a plurality of axial pin holes 9, the master plug 6 defining together with the control plug 5 a second shear line $L_2$ therebetween, and together with said stationary plug 2 a master shear line $L_3$ therebetween; top pins 11, master pins 12 and bottom pins 13 inserted together into the axial pin holes 7, 8, 9 and 10 of the rotary plug 4, the control plug 5, the master plug 6, and the stationary plug 2; a plurality of springs 14 fitting into the pin holes 10 of the stationary plug 2 so as to bias the top pins 11, the master pins 12, and the bottom pins 13 forward; a first key 15 which brings the rear ends of the top pins 11 and the front ends of the master pins 12 into alignment with the first shear line $L_1$ so that only the rotary plug 4 can rotate; a second key 16 which brings the rear ends of the top pins 11 and the front ends of the master pins 12 into alignment with the second shear line $L_2$ so that only the rotary plug 4 and the control plug 5 can rotate; and a master key 17 which brings the rear ends of the master pins 12 and the front ends of the bottom pins 13 into alignment with the master shear line $L_3$ so that the rotary plug 4, the control plug 5 and the master plug 6 can rotate. The control plug 5 is provided with projections 18 and 19 on its front and rear faces, respectively, the rotary plug 4 has a recess in its rear face into which the front projection 18 of the control plug 5 can fit loosely, and the master plug 6 has a recess 21 in its front face into which the rear face projection 19 of the control plug 5 can fit loosely, so that the directions in which the actuating shaft 3 is rotated by the first and second keys are made to be opposite to each other according to the way in which side walls of the projections 18 and 19 come into contact with side walls of the recesses 20 and 21, respectively.

In the embodiment shown, the stationary plug 2 is held within the cylinder 1 by a fixing pin 22 which is inserted through the side wall of the cylinder 1. The actuating shaft 3 projects integrally from the central portion of the rear face of the rotary plug 4, and is inserted rotatably in bores 23, 24 and 25 which are formed in the central portions of the control plug 5, the master plug 6, and the stationary plug 2, respectively. A rear end portion **3*b* of the actuating shaft 3, which projects from the rear face of the stationary plug 2, is provided or equipped with a drive portion for driving the object being actuated, e.g., a switch. A front end portion 3*a* of the actuating shaft 3, which projects into the central portion of the front face of the rotary plug 4, is used as a guiding and receiving portion for the first key 15, the second key 16 and the master key 17, all of which have cylindrical shapes, and an upper circumferential portion of the actuating shaft is provided with a longitudinal linkage groove 26 which extends as far as the front face of the rotary plug 4**.

Figure 15:
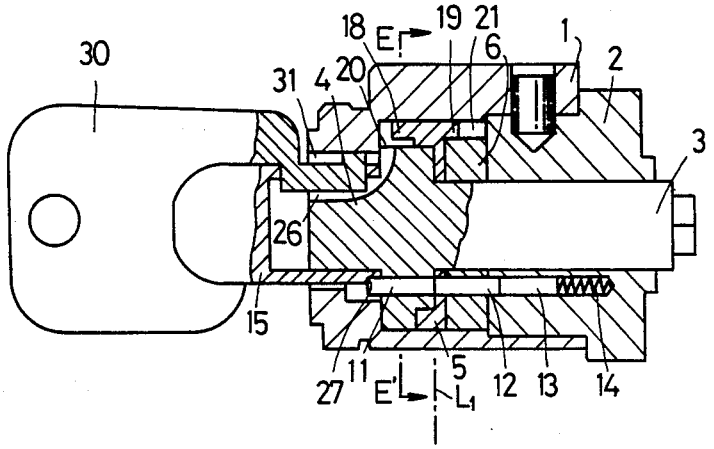
FIG. 15 is a section similar to FIG. 2, but also showin the locking device when a first key is inserted.
Figure 16:
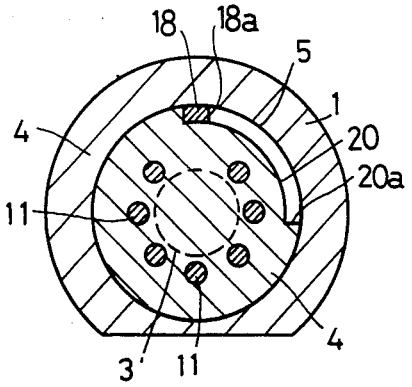
FIG. 16 is a section taken along the line E—E′ of FIG. 15.
Figure 18:
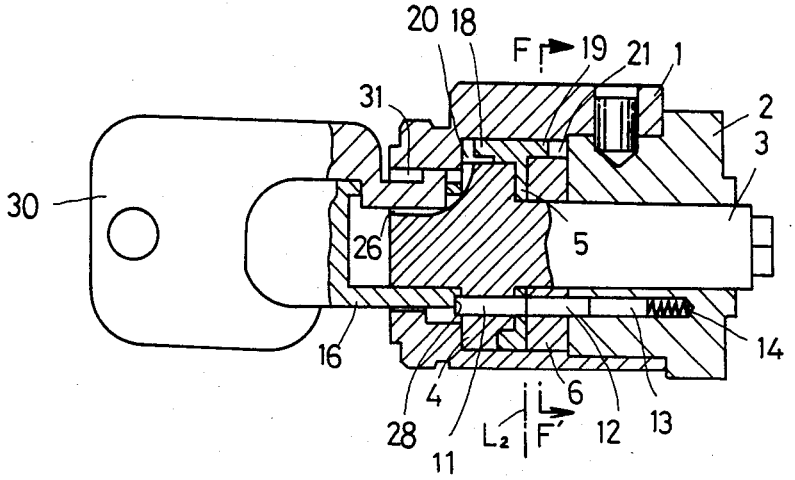
FIG. 18 is a section similar to FIG. 2, but showing the locking device when a second key is inserted.
Figure 19:
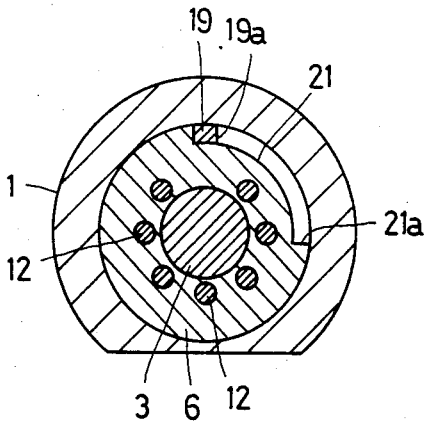
FIG. 19 is a section taken along the line F—F′ of FIG. 18.

There are seven each of the top pins 11, the master pines 12 and the bottom pins 13, and the positions of the top pins 11 are set in two stages as provided by use of the different keys 15 and 16. The thickness of the control plug 5 is equal to the difference between the depth of face notches provided in a pin pushing face in the first and second keys. A notch in a top pin-pushing face 28 formed on the outer circumference of the second key 16 (see FIG. 18) is shallower by the thickness of the central body portion of control plug 5 than a notch in a top pin-pushing face 27 formed in the outer circumference of the first key 15 (see FIG. 15). The thickness of the body portion of the control plug 5 is regulated by the difference in the depth of the notches provided in the key pin-pushing faces of the first and second keys as described above, so that it is relatively small. For reinforcing purposes, therefore, the front face of the control plug 5 has a short cylindrical portion **5*a* formed thereon, into which a reduced diameter portion 4*a* of the rear face of the rotary plug 4** fits.

The front face projection 18 and the rear face projection 19 of the control plug 5 are formed at the same angular position on the upper circumferential edge thereof, and the rear face recess 20 of the rotary plug 4 and the front face recess 21 of the master plug 6 are formed so as to extend through the whole thickness of the rotary plug 4 and the master plug 6, respectively. The cut-out angles of the rear face recess 20 and the front face recess 21 are determined by adding 90 degrees to the angular widths of the front face projection 18 and the rear face projection 19, respectively. The rear face of the stationary plug 2 is provided with threaded holes 29 for mounting the object being actuated, e.g., a switch. The front face of the cylinder 1 is provided with an insertion positioning groove 31, into which fits an upper edge of an actuating shaft driving plate 30 of each key 15, 16, or 17.

Figure 17:
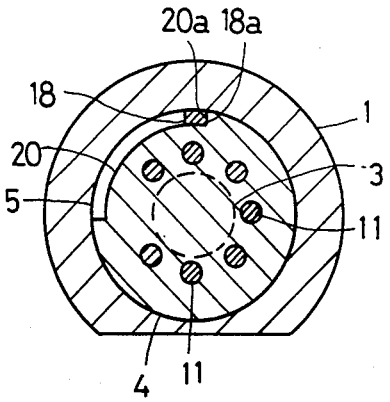
FIG. 17 is a section similar to FIG. 16, but showing the locking device when the first key is turned counterclockwise.

When the first key 15 is inserted into the cylinder 1, the rear ends of the top pins 11 and the front ends of the master pins 12 come into alignment with the first shear line $L_1$, but the master pins 12 cross the second shear ling $L_2$ and the bottom pins 13 cross the master shear line $L_3$. As a result, if the first key 15 is turned counterclockwise as viewed in FIG. 1, i.e., to the left, only the rotary plug 4 is rotated. When a side wall **20*a* of the rear face recess 20 is brought into contact with a side wall 18*a* of the front face projection 18 after a rotation of 90 degrees (see FIG. 17), the rotation of the rotary plug 4 and the actuating shaft 3** is stopped and one operation is effected, e.g., a switch is turned on.

Figure 20:
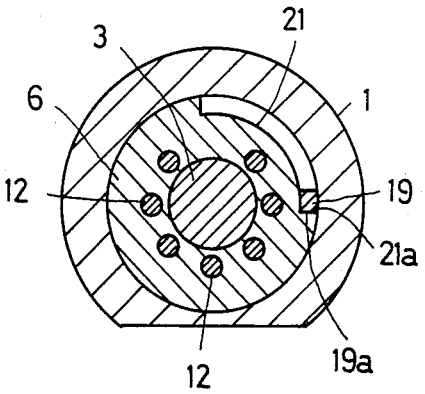
FIG. 20 is a section similar to FIG. 19, but showing the locking device when the second key is turned clockwise.
Figure 21:
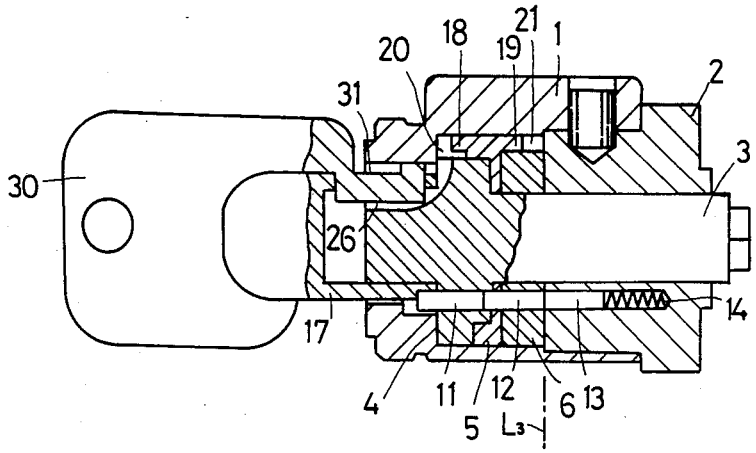
FIG. 21 is a section similar to FIG. 2, but showing the locking device when a master key is inserted.

When the second key 16 is inserted into the cylinder 1, the rear ends of the top pins 11 and the front ends of the master pins 12 come into alignment with the second shear line $L_2$. but the top pins 11 cross the first shear line $L_1$ and the master pins 12 cross the master shear line $L_3$. As a result, if the second key 16 is turned clockwise as viewed in FIG. 1, i.e., to the right, only the rotary plug 4 and the control plug 5 are rotated. When a side wall **19*a* of the rear face projection 19 is brought into contact with a side wall 21*a* of the front face recess 21 after a rotation of 90 degrees (see FIG. 20), the rotation of the two plugs 4 and 5 and the actuating shaft 3** is stopped and another operation is effected, e.g., another switch is turned on.

When the master key 17 is inserted into the cylinder 1, the rear ends of the master pins 12 and the front ends of the bottom pins 13 come into alignment with the master shear line $L_3$, but the master pins 12 cross the second shear line $L_2$, and the top pins 11 or the master pins 12 cross the first shear line $L_1$. As a result, the rotary plug 4, the control plug 5 and the master plug 6 can be rotated together. This master key 17 can be freely rotated clockwise or counterclockwise through 360 degrees, independently of the projections 18 and 19 and the recesses 20 and 21, making its action different from the first key 15 and second key 16. As a result, the first operation can be conducted by turning the master key 17 counterclockwise through 90 degrees, and the second operation can be conducted by turning the master key 17 clockwise through 90 degrees, so that two separate and different actions can be controlled together by the master key 17. Moreover, if a third object to be actuated, e.g., a third switch, is additionally provided at an angular position which is separated by 180 degrees, for example, from the key-insertion position, another action can be conducted by turning the master key 17 through 180 degrees.

For the driving unit for the objects being actuated, which is attached to the rear end portion 3*b* of the actuating shaft 3, suitable means can be selected according to the construction or kind of the objects being actuated, for example; cam lands, cam plates, magnets, or light-emitting elements.

As has been described hereinbefore, in the double-acting locking device for joint control according to the present invention, the rotary plug 4, the control plug 5, the master plug 6, and the stationary plug 2 fit in contact in the cylinder 1. The connections and disconnections of those plugs are effected by the actions of the top pins 11, the master pins 12, and the bottom pins 13, all of which fit into axial pin holes 7, 8, 9, and 10 formed in those plugs, and which are biased forward by springs 14. A selection of the connections and disconnections of the plugs is effected by means of the first key 15, the second key 16 and the master key 17. The rotational directions and angles of the actuating shaft 3 produced by the first and second keys 15 and 16 are controlled by the actions of the front and rear face projections 18 and 19 of the control plug 5, the rear face recess 20 of the rotary plug 4 and the front face recess 21 of the master plug 6. The locking device of the present invention adopts an axial pin tumbler lock as its fundamental construction. As a result, the locking device of the present invention enables a convenient transportation and storage of the keys and prevents the warping and deformation of the keys, making it different from the conventional double-acting locking device for joint control in which a flat key has to be very long. The locking device of the present invention is free from problems in operation, and has an excellent durability.

What is claimed is:

1. A double-acting locking device for joint control, comprising:

a stationary plug provided with a plurality of axial pin holes;

a cylinder mounted coaxially on a front portion of said stationary plug;

a rotary plug fitting rotatably into said cylinder, which is provided with an actuating shaft on a rear face thereof and a plurality of axial pin holes;

a control plug fitting rotatably into said cylinder in contact with said rear face of said rotary plug and which is provided with a plurality of axial pin holes, said control plug defining together with said rotary plug a first shear line therebetween;

a master plug fitting rotatably into said cylinder in contact with both a rear face of said control plug and a front face of said stationary plug, and which is provided with a plurality of axial pin holes, said master plug defining together with said control plug a second shear line therebetween, and together with said stationary plug a master shear line therebetween;

a plurality of top pins, master pins, and bottom pins inserted together into the axial pin holes of said rotary plug, said control plug, said master plug and said stationary plug;

a plurality of springs fitting in the pin holes of said stationary plug so as to bias said top pins, said master pins and said bottom pins forward;

a first key having a plurality of notches on a pin-pushing face, said first key notches having a depth which brings the rear ends of said top pins and the front ends of said master pins into alignment with said first shear line so that only said rotary plug can rotate;

a second key having a plurality of notches on a pin-pushing face, said second key notches having a depth which brings the rear ends of said top pins and the front ends of said master pins into alignment with said second shear line so that only said rotary plug and said control plug can rotate; and a master key which brings the rear ends of said master pins and the front ends of said bottom pins into alignment with said master shear line so that said rotary plug, said control plug, and said master plug can rotate;

wherein said control plug is provided with projections on its front and rear faces, respectively, thereof;

said rotary plug has a recess in the rear face thereof into which the front face projection of said control plug can fit loosely; and said master plug has a recess in the front face thereof into which the rear face projection of said control plug can fit loosely, so that the directions in which said actuating shaft is rotated by said first and second keys are made to be opposite to each other according to the way in which side walls of said projections come into contact with side walls of said recesses, and wherein said control plug has thickness equal to the depth difference of the notches in said first and second keys.

2. The locking device of claim 1, wherein said notches provided in a top pin pushing face formed in the outer circumference of said second key are shallower by the thickness of said control plug than said notches formed on a pin pushing face in the outer circumference of said first key.

3. The locking device of claim 1, wherein a driving unit is attached to the rear portion of said actuating shaft.

4. The locking device of claim 1, wherein there are provided seven each of said top pins, said master pins and said bottom pins.

5. A double-acting locking device of an axial pin tumbler type for joint control, including:

an outer cylinder containing a rotary plug, a control plug, a master plug and a stationary plug each disposed in contact facing with one another within said cylinder, said rotary plug being provided with an integral actuating shaft extending from a rear central portion of said rotary plug to provide a drive portion;

a plurality of top pins, master pins and bottom pins for effecting connections and disconnections between said rotary plug, control plug, and master plug, all of said pins being disposed into axial pin holes formed in said plugs, said pins being spring-biased in a forward direction;

a first key having a pllurality of notches on a pin pushing face.

a second key having a plurality of notches on a pin pushing face, said second key notches having a depth which brings the rear ends of said top pins and the front ends of said master pins into alignment with a second shear line so that only said rotary plug and said control plug can rotate, and a master key adapted for bringing the rear ends of said master pins and the front ends of said bottom pins into alignment with a master shear line so that said rotary plug, said control plug, and said master plug can rotate;

wherein said control plug is provided with projections on its front and rear faces, which projections loosely interfit into a rear face recess on the rotary plug and a front face recess on the master plug, respectively, so that rotational direction and angles of said actuating shaft being set by said first and second keys can be controlled by action of said front and rear face projections on said control plug, on the rear face recess of said rotary plug and on the front face of said master plug, and said actuating shaft drive portion can be rotated to actuate a driving unit.

* * * * *